US006051087A

United States Patent [19]

Hutchens et al.

[11] Patent Number: 6,051,087

[45] Date of Patent: Apr. 18, 2000

[54] LOW SMOKE ROCKET MOTOR LINER COMPOSITIONS

[75] Inventors: Dale E. Hutchens, Huntsville, Ala.; Norman Cohen, Redlands, Calif.

[73] Assignee: Cordant Technologies Inc., Salt Lake City, Utah

[21] Appl. No.: 07/991,467

[22] Filed: Dec. 16, 1992

Related U.S. Application Data

[63] Continuation-in-part of application No. 07/827,171, Jan. 29, 1992, abandoned.

[51] Int. Cl.[7] ..... C06B 45/10

[52] U.S. Cl. ..... 149/19.4; 102/290; 149/19.1; 149/19.5; 149/19.6; 523/180

[58] Field of Search ..... 102/290; 149/19.4, 149/19.1, 19.5, 19.6; 523/180

[56] References Cited

U.S. PATENT DOCUMENTS

| | | | |
|---|---|---|---|
| H523 | 9/1988 | Braun | 102/290 |
| 3,476,622 | 11/1969 | Harada et al. | 149/19 |
| 3,714,047 | 1/1973 | Marion et al. | 102/290 |
| 3,822,154 | 7/1974 | Lawrence et al. | 149/19.1 |
| 3,853,646 | 12/1974 | Frankel et al. | 149/19.4 |
| 3,882,784 | 5/1975 | Nauflett et al. | 102/103 |
| 3,948,697 | 4/1976 | Flanagan et al. | 149/11 |
| 3,961,476 | 6/1976 | Wasserman et al. | 60/255 |
| 4,021,514 | 5/1977 | Daume | 149/19.4 |
| 4,052,943 | 10/1977 | Elrick | 102/103 |
| 4,165,247 | 8/1979 | Brew et al. | 149/19.4 |
| 4,201,605 | 5/1980 | Reed, Jr. et al. | 149/19.1 |
| 4,209,351 | 6/1980 | Pierce et al. | 149/19.1 |
| 4,232,608 | 11/1980 | Wrightson | 102/103 |
| 4,337,218 | 6/1982 | Byrd et al. | 264/3 R |
| 4,375,522 | 3/1983 | Braun | 102/290 |
| 4,379,903 | 4/1983 | Reed, Jr. et al. | 528/55 |
| 4,429,634 | 2/1984 | Byrd et al. | 102/290 |
| 4,536,235 | 8/1985 | Lelu et al. | 149/19.4 |
| 4,638,735 | 1/1987 | Lelu et al. | 102/290 |
| 4,670,068 | 6/1987 | Chi | 149/19.4 |
| 4,736,684 | 4/1988 | Byrd et al. | 102/290 |
| 4,798,142 | 1/1989 | Canterberry et al. | 102/290 |
| 4,803,019 | 2/1989 | Graham et al. | 264/3.1 |
| 4,878,431 | 11/1989 | Herring | 102/290 |
| 4,913,753 | 4/1990 | Ducote | 149/19.9 |
| 4,968,365 | 11/1990 | Krone | 149/41 |
| 5,071,495 | 12/1991 | Willer et al. | 149/19.9 |

FOREIGN PATENT DOCUMENTS

| | | |
|---|---|---|
| 2 038 346 | 7/1980 | United Kingdom . |
| 1 506 320 | 7/1989 | United Kingdom . |

*Primary Examiner*—Edward A. Miller
*Attorney, Agent, or Firm*—Pillsbury Madison & Sutro LLP

[57] ABSTRACT

A formulation is provided which is capable of performing as a liner layer between a rocket motor casing and the propellant grain disposed within the interior of the rocket motor casing. The composition produces relatively little smoke during the operation of the rocket motor and is capable of securely bonding a wide range of conventional propellants to a wide range of conventional casings. In one preferred formulation, the liner consists of from from about 50% to about 75% oxygen containing polymer; from about 3% to about 15% curing agent; from about 5% to about 50% filler and from about 0.01% to about 0.5% cure catalyst.

5 Claims, No Drawings

LOW SMOKE ROCKET MOTOR LINER COMPOSITIONS

RELATED APPLICATIONS

This application is a continuation-in-part application of Applicants' application Ser. No. 07/827,171 filed Jan. 29, 1992 now abandoned entitled LOW SMOKE LINER COMPOSITION, which application is incorporated herein by this reference.

BACKGROUND

1. The Field of the Invention

The present invention is related to methods and compositions for substantially reducing smoke emissions from rocket motors during operation. More particularly, the present invention is related to a low smoke producing liner formulation for use in bonding rocket motor propellants within rocket motor casings.

2. Technical Background

In the manufacture of solid rocket motors, several components have been found to be essentially required. First there must be an adequate rocket motor case. The rocket motor case forms the exterior of the rocket motor and provides the essential structural integrity. The rocket motor case is conventionally manufactured from a rigid, yet durable, material such as steel or filament wound composite.

Placed within the interior of the rocket motor case is the propellant grain. The propellant forming the grain is conventionally burned to form thrust within the interior of the rocket motor case. The formation of hot gases upon burning of the propellant, and the subsequent exit of those gases through the throat and nozzle of the case provide the thrust to propel the rocket motor.

A further important component of the rocket motor is a liner layer, which is typically disposed between the rocket motor case and the propellant grain. The liner layer essentially comprises an insulator and adhesive. The liner holds the propellant in place within the rocket motor case and assures that the propellant will not move relative to the case during the operation of the rocket motor.

It is important that the case be insulated from the burning propellant grain sufficiently that the heat generated by the propellant does not damage the case. The liner helps to perform this function. It is important, for example, that the propellant not burn through the rocket motor case. If this occurs, the rocket motor is likely to fail.

In addition, the liner performs the important function of confining the combustion of the propellant to the desired location within the rocket motor case. Often propellant grains are specifically engineered and configured such that they burn in a specific manner in order to provide the desired level of thrust throughout the operation of the rocket motor. If burning were to inadvertently occur between the case and the propellant grain, it would be possible for the rocket to experience undesirable and uncontrolled thrust during the operation of the motor.

Accordingly, it will be appreciated that the liner is an important component of the overall rocket motor. It serves a number of important functions. The liner acts as an adhesive, bonding the propellant grain to the casing. The liner also insulates the casing from the burning propellant and confines the ignition of the propellant to the desired location.

In some applications, it is important that the rocket motor perform with reduced or eliminated smoke output. Work is ongoing in the area of development of low smoke propellants. One problem that continues to be encountered in the production of "smokeless" rocket motors, however, has been the liner used. The burning of conventional liners during rocket motor operation produces significant quantities of smoke, even in motors which use smokeless propellants.

In many settings, such as in the use of tactical rocket motors, the production of smoke causes a number of disadvantages. The smoke produced may obscure the vision of pilots or drivers of crafts firing such tactical rockets. In addition, the production of smoke makes tracking the source of the motor easier, a serious disadvantage during military operations.

Accordingly, it would a be significant advancement in the art to provide methods and compositions for reducing smoke produced during the operation of rocket motors. More specifically, it would be an advancement in the art to provide a liner which produced relatively little smoke upon combustion of the propellant grain. It would be a further advancement in the art to provide such a liner which was also capable of securely bonding a variety of propellants within a variety of conventional rocket motors. It would be a further advancement in the art to provide methods for production and use of such liner formulations.

Such methods and compositions are disclosed and claimed herein.

BRIEF SUMMARY AND OBJECTS OF THE INVENTION

The present invention is related to methods and compositions for substantially reducing smoke emissions from rocket motors during operation. Specifically, the present invention is related to low smoke producing liner formulations for use in bonding rocket motor propellants within rocket motor casings. The formulation of the present invention is adaptable to provide an adhesive and insulation layer between the propellant and the casing, which adhesive produces a relatively small amount of smoke upon combustion.

Typical compositions within the scope of the present invention employ a combination of an oxygen containing polymer, a curing agent, a filler, and a catalyst such as dibutyltin dilaurate. The filler may, for example, include dicyandiamide, ammonium nitrate, or silica. These compositions are found to produce remarkably little smoke during the operation of the rocket motor. The liner formulations, however, also adequately perform all of the important functions of typical liners.

As mentioned above, the polymer is preferably an oxygen containing polymer. The polymer may, for example, be selected from the group consisting of polyethers, polyglycols, polyesters, polyamides, and polycarbonates. In one preferred embodiment, the polymer comprises polythioglycol (PTG) or polythioether diol. PTG is commercially available from Morton, International, while polythioether diol is commercially available from Products Research and Chemical Corporation. The polymer preferably comprises from about 50% to about 75% of the overall composition; however, liner compositions having more or less polymer may also be acceptable in certain applications. In particular, in some embodiments a more preferred range of polymer may be from about 52% to about 65%.

As mentioned above, the composition of the present invention also comprises an isocyanate curing agent. The curing agent may, for example be selected from the group consisting of toluene diisocyanate (TDI), methylene bis diphenyl isocyanate (MDI), hexamethylene diisocyanate (HMDI), dimer diisocyanate (DDI), isophorone diisocyanate (IPDI), Desmodur W, and polymer abducts of the above isocyanates. In one preferred embodiment, the isocyanate curing agent comprises a mixture of Cythane®, manufactured by American Cyanamid, and tetramethylxylene diisocyanate.

In typical formulations the isocyanate curing agent will comprise from about 3% to about 15% of the composition. In most applications, the isocyanate curing agent will comprise from about 5% to about 15% of the overall composition. In some embodiments a more preferred range will be from about 6% to about 9%.

The preferred formulation of the present invention also includes a cure catalyst. The cure catalyst is chosen such that an adequate cure of the overall composition is achieved. Numerous cure catalysts are known in the art. One such cure catalyst is dibutyltin dilaurate (DBTDL). The cure catalyst typical forms from about 0.01% to about 0.5% of the composition.

As mentioned above, the present invention also consists of a filler such as dicyandiamide (DCDA), ammonium nitrate, or silica. It is found that this filler further mitigates heavy black smoke production. As a result of the use of the filler in the overall liner formulation, it is found that the composition of the present invention produces much less smoke output than conventional liners. Typically, the filler will comprise from about 5% to about 50% of the composition. In some embodiments, a more preferred range of filler is from about 20% to about 40%.

Accordingly, it is a primary object of the present invention to provide methods and compositions for reducing smoke produced during the operation of rocket motors.

More specifically, it is an object of the present invention to provide a liner which produces relatively little smoke upon combustion of the propellant grain.

It is a further object of the present invention to provide such a liner which is also capable of securely bonding a variety of propellants within a variety of conventional rocket motors.

It is another object of the present invention to provide methods for production and use of such liner formulations.

These and other objects and advantages of the invention will become apparent upon reading the following detailed description and appended claims.

DETAILED DESCRIPTION OF THE PREFERRED EMBODIMENTS

The present invention comprises a composition which is suitable for use as a rocket motor liner. As such, the liner is capable of acting as an adhesive between the propellant grain and the rocket motor casing. At the same time, the liner of the present invention produces substantially reduced smoke during the operation of the rocket motor than conventional liners.

As mentioned above, one preferred embodiment of the present invention comprises a mixture of an oxygen containing polymer, an isocyanate curing agent, a catalyst, and a filler. The polymer may, for example, be selected from polyethers, polyglycols, polyesters, polyamides, and polycarbonates. Testing has shown that binders such as PTG and PEG (polyethylene glycol or polyethylene oxide) perform very will and produce significantly less smoke than hydrocarbon rubber binders.

In one embodiment of the invention the polymer comprises polythioglycol (PTG) of thiodiglycol polyether (Morton, International). Alternatively, Permapol P3-855 polythioether diol (Products Research and Chemical Corporation) is found to perform well within the scope of the present invention.

The backbone structure is as follows:

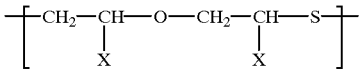

where X is H or $CH_3$.

PTG manufactured by different manufactures may differ in molecular weight, molecular weight distribution, synthesis conditions and the feed monomers used. The present invention, however, relates generally to polymeric binders which contain oxygen in the backbone. Thus, the present invention is not limited to specific polymers or specific manufactures. As mentioned above, the polymer will typical comprise from about 50% to about 75% of the liner composition.

It is important to select a curing agent which is effective with the polymer used. The curing agent will typically comprise any isocyanate which is compatible with the other components of the mixture. In one embodiment of the present invention CYTHANE® is employed. CYTHANE® comprises a trimethylol propane (TMP) adduct of tetramethylxylene diisocyanate (TMXDI®). TMXDI and CYTHANE are available commercially from American Cyanamid Company.

The chemical structure of TMXDI is:

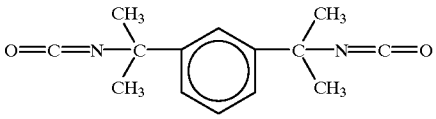

The chemical structure of CYTHANE is approximately:

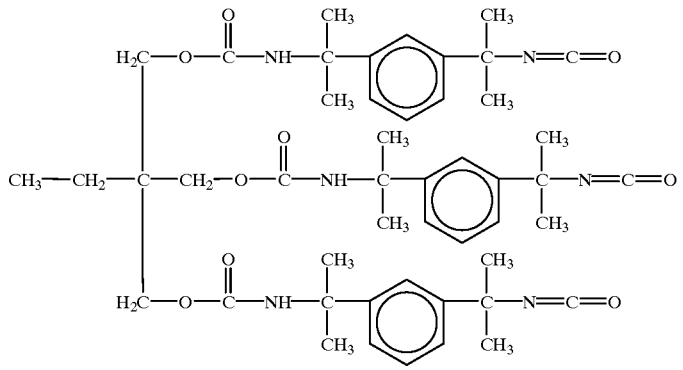

Sufficient curing agent is used to provide an adequate cure of the liner formulation. Typically, the curing agent will comprise from about 3% to about 15% of the composition. Cythane may be employed as a cure agent in that Cythane and PAPI® (Dow Chemical) are soluble in PTG. Cythane is also found to be less physiologically hazardous than PAPI.

As mentioned above, a suitable cure catalyst, such as dibutyltin dilaurate may be employed to speed the cure rate. This material is a common catalyst for such urethane forming reactions.

A filler may also be added to the composition to form from about 5% to about 50% of the composition. As mentioned above, dicyandiamide (DCDA) comprises one preferred filler. DCDA has the following chemical structure:

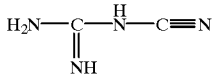

Other fillers may also be substituted. Examples of such fillers include ammonium nitrate and silica.

Typical overall compositions within the scope of the invention are comprised of from about 50% to about 75% oxygen containing polymer; from about 3% to about 15% curing agent; and from about 5% to about 50% filler. A cure catalyst may be added to this basic composition. One such cure catalyst is dibutyltin dilaurate which will typically be added up to about 0.2% of the composition.

Compositions within the scope of the present invention are found to perform all of the functions of conventional liners, but provide the added benefit of producing reduced smoke during operation of the rocket motor. This is a significant advantage in many settings, such as in the use of tactical rocket propelled devices.

EXAMPLES

The following examples are given to illustrate embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

A new low smoke liner formulation has been formulated. The formulation includes the following components shown by weight percent below:

| Ingredient | weight % |
|---|---|
| Permapol P3-855, Polymer | 52.91 |
| Cythane, Curing Agent | 7.03 |
| Dicyandiamide, Filler | 40.00 |
| Dibutyltin Dilaurate, Catalyst | 0.06 |

Permapol was obtained from Products Research & Chemical Corporation, 410 Jersey Avenue, Gloucester City, N.J. 08030 and Cythane was obtained from American Cyanamid Company, One Cyanamid Plaza, Wayne, N.J. 07470. As mentioned above Permapol P3-855 is a polythioether diol polymer.

When tested it was observed that a significant reduction in visual smoke was achieved. Also, the formulation was characterized by excellent adhesion to several propellants, including the Crosslinked Double Base (CDB) propellant manufactured by Thiokol Corporation, Huntsville, Alabama Division, and minimum smoke propellants using Glycidyl Azide Polymer (GAP) binder. Representative GAP adhesion data is shown below:

| Liner Type | Peel Value (pli) | Failure Mode |
|---|---|---|
| PTG/DCDA | 24.0 | 50% L, 15% P, 35% BL/P |
| TL-H755 | 2.9 | 100% TCP/L |
| PTG/DCDA | 26.0 | 5% P, 2% BL/Shim, 93%L |
| TL-H755 | 9.8 | 100% TCP/L |

The 24.0 and 26.0 pli peel bond strengths are higher than typically observed in connection with GAP propellants.

Example 2

In this example several liner formulations were formulated and tested.

Table I illustrates the visual characterization of smoke evolution by liner formulations. It will be appreciated from Table I that formulations falling within the scope of the present invention produce significantly less smoke than more conventional liner systems.

TABLE I

VISUAL CHARACTERIZATION OF SMOKE EVOLUTION BY LINER FORMULATIONS

| | Weight Blank Tube (g) | Weight Lined Tube (g) | Weight After Firing (g) | Smoke Character 0.0–0.5 Sec. Post Burn Out |
|---|---|---|---|---|
| | Set 1 | | | |
| Blank Tube | 569 | — | 569 | None |
| HTPB/DDI Gumstock | 569 | 638 | 632 | Heavy |
| HTPB/DDI + 10% DCDA, 30% Thermax | 569 | 660 | 654.5 | Heavy |
| HTPB/DDI + 20% DCDA, 20% Thermax | 572 | 661 | 656 | Slight Reduction |
| HTPB/DDI + 30% DCDA, 10% Thermax | 579 | 666 | 659.5 | Significant Reduction |
| HTPB/DDI + 40% DCDA | 572 | 657.5 | 650 | Faint Grey |
| HTPB/DDI + 40% Thermax | 570 | 667.5 | 656.5 | Heavy |
| | Set 2 | | | |
| HTPB/DDI + 40% Thermax | 576 | 667 | 661 | Heavy |
| HTPB/AN | — | 679 | 673 | Faint Grey |
| PTG/Cythane + 40% Thermax | 577 | 674 | 669.5 | Grey |
| PTG/Cythane + 40% DCDA | 576 | 669 | 661 | Faint Grey |
| HTPB/DDI + 40% Thermax (No Pressure Apparatus) TP-Q7030 Mix # 21Q-994 | 576 | 667 | 662 | Heavy |

Example 3

In this example, a liner within the scope of the present invention was formulated. The formulation included the following components:

| Material | weight-gms | weight % |
|---|---|---|
| P3-855 Polymer | 223.875 | 74.625 |
| Cythane | 31.020 | 10.340 |
| DCDA | 45.000 | 15.000 |
| DBTDL | 0.105 | 0.035 |

The formulation set forth above provided an acceptable low smoke liner formulation.

Example 4

In this example, a liner within the scope of the present invention was formulated. The formulation included the following components:

| Material | weight-gms | weight % |
|---|---|---|
| PTG | 600.0 | 60.0 |
| Cythane | 100.0 | 10.0 |
| DCDA | 299.7 | 29.97 |
| DBTDL | 0.3 | 0.03 |

The formulation set forth above provided an acceptable low smoke liner formulation.

Example 5

In this example, a liner within the scope of the present invention was formulated. The formulation included the following components:

| Material | weight-gms | weight % |
|---|---|---|
| P3-855 Polymer | 276.3 | 61.4 |
| Cythane | 38.3 | 8.5 |
| DCDA | 135.0 | 30.0 |
| DBTDL | 0.14 | 0.03 |

The formulation set forth above provided an acceptable low smoke liner formulation.

Example 6

In this example, a liner within the scope of the present invention was formulated. The formulation included the following components:

| Material | weight-gms | weight % |
|---|---|---|
| PTG | 171.21 | 57.07 |
| Cythane | 23.70 | 7.90 |
| DCDA | 105.00 | 35.00 |
| DBTDL | 0.09 | 0.03 |

The formulation set forth above provided an acceptable low smoke liner formulation.

Summary

In summary, the liner formulations of the present invention achieve each of the objects set forth above. The present invention provides methods and compositions for reducing smoke produced during the operation of rocket motors. The formulations of the present invention provide a liner which produces relatively little smoke upon combustion of the propellant grain. Further such liner formulations are capable of securely bonding a variety of propellants within a variety of conventional rocket motors.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A rocket motor liner composition comprising:

from about 50% to about 75% polymer selected from the group consisting of polyethers, polyglycols, polyesters, polyamides, and polycarbonates;

from about 3% to about 15% curing agent; and from about 20% to about 40% filler selected from the group consisting of dicyandiamide, ammonium nitrate, and silica;

wherein said composition is formulated such that it is capable of providing an adhesive and insulation layer between a propellant and a rocket motor case.

2. A rocket motor liner composition as defined in claim 1 further comprising from about 0.01% to about 0.5% dibutyltin dilaurate.

3. A rocket motor liner composition as defined in claim 1 wherein said polymer comprises polythioglycol.

4. A rocket motor liner composition as defined in claim 1 wherein said curing agent is an isocyanate curing agent selected from the group consisting of toluene diisocyanate, methylene bis di phenyl isocyanate, hexamethylene diisocyanate, dimer diisocyanate, isophorone diisocyanate, and tetramethylxylene diisocyanate.

5. A rocket motor liner composition consisting essentially of:

from about 50% to about 75% polymer selected from the group consisting of polyethers, polyglycols, polyesters, polyamides, and polycarbonates;

from about 3% to about 15% isocyanate curing agent; and from about 5% to about 50% filler selected from the group consisting of dicyandiamide, ammonium nitrate, and silica;

wherein said composition is formulated such that it is capable of providing an adhesive and insulation layer between a propellant and a rocket motor case.

* * * * *